US009175498B2

(12) United States Patent
Winslow et al.

(10) Patent No.: US 9,175,498 B2
(45) Date of Patent: Nov. 3, 2015

(54) SANITARY DISPENSING SYSTEM

(76) Inventors: Andrew R. Winslow, Westwood, MA (US); Phuoc Van, Attleboro, MA (US)

( * ) Notice: Subject to any disclaimer, the term of this patent is extended or adjusted under 35 U.S.C. 154(b) by 1707 days.

(21) Appl. No.: 12/459,162

(22) Filed: Jun. 26, 2009

(65) Prior Publication Data

US 2010/0327000 A1 Dec. 30, 2010

(51) Int. Cl.

| | |
|---|---|
| ***A47K 10/24*** | (2006.01) |
| ***B65H 1/00*** | (2006.01) |
| ***E05B 1/00*** | (2006.01) |
| ***A47K 10/46*** | (2006.01) |

(52) U.S. Cl.

CPC ..... *E05B 1/0069* (2013.01); *A47K 10/46* (2013.01)

(58) Field of Classification Search

CPC ..... E05B 1/0069; A47K 10/46
USPC ..... 221/282, 97; 248/315
See application file for complete search history.

(56) References Cited

U.S. PATENT DOCUMENTS

| | | | | |
|---|---|---|---|---|
| 2,512,417 | A * | 6/1950 | Cook | 248/315 |
| 3,495,571 | A * | 2/1970 | Evans | 118/325 |
| 3,854,624 | A * | 12/1974 | Canci | 221/96 |
| 4,644,689 | A * | 2/1987 | Arians | 49/70 |
| 4,703,850 | A * | 11/1987 | Walker | 206/293 |
| 4,928,849 | A * | 5/1990 | Khozai | 221/45 |
| 6,021,920 | A * | 2/2000 | Aldape | 221/96 |
| 6,237,805 | B1 * | 5/2001 | Katsanevas | 221/45 |
| 6,330,816 | B1 * | 12/2001 | O'Connor | 70/63 |
| 6,508,383 | B2 * | 1/2003 | Lidahl et al. | 221/97 |
| D483,207 | S | 12/2003 | Winslow | |
| 6,789,695 | B1 * | 9/2004 | Gaudreau | 221/102 |
| 6,959,890 | B1 * | 11/2005 | Breitinger | 242/592 |
| 7,287,668 | B1 * | 10/2007 | Renaud | 221/283 |
| 7,320,418 | B2 * | 1/2008 | Sassoon | 222/649 |
| 7,757,351 | B2 * | 7/2010 | Davis, Jr. | 16/412 |
| 2006/0151519 | A1 * | 7/2006 | White | 221/63 |

* cited by examiner

*Primary Examiner* — Rakesh Kumar
(74) *Attorney, Agent, or Firm* — Ingrid McTaggart

(57) ABSTRACT

The present invention provides a sanitary dispensing system including an elongate member configured to be secured to a door, a dispensing device secured to the elongate member, the dispensing device configured for dispensing hand cleansing materials, and a receptacle device secured to the elongate member and configured for receiving hand cleansing materials.

19 Claims, 4 Drawing Sheets

SANITARY DISPENSING SYSTEM

BACKGROUND OF THE INVENTION

Public locations, such as bathrooms, waiting rooms, petting zoos, cafeterias, doctors offices, and the like, may be breeding grounds for germs, such as bacteria and viruses, and therefore may be locations that increase the spread of contagious diseases. Accordingly, it may be desirable to provide a system that facilitates the reduction of the spread of germs and increases the likelihood that individuals visiting these locations will cleanse their hands and properly dispose of used cleansing materials.

SUMMARY OF THE INVENTION

The present invention provides a door mounted cleaning system that may include a dispenser for hand wipes, a trash receptacle, and a door covering member, which may reduce of the spread of germs and may increase the likelihood that individuals passing through the door will cleanse their hands and properly dispose of used hand cleaning materials.

DETAILED DESCRIPTION OF THE DRAWINGS

Many patrons of bathrooms, waiting rooms, petting zoos, cafeterias, doctors offices, grocery stores, and the like, would like to cleanse their hands before or after visiting such locations. However, many of these patrons may correctly believe that germs may exist on the door knob and on door surfaces surrounding the door knob. These germs may be left on these surfaces by previous entering or exiting patrons that did not cleanse their hands before entering or exiting through the door. In an effort to maintain the cleanliness of their own hands while passing through a door, many patrons may utilize a paper towel that was used for drying their hands, to turn the door knob. The patron must then hold the door open, without contacting the door with their hands, as they attempt to throw the paper towel into a garbage receptacle by a sink, or perhaps located across the room, for example. In another scenario, the patron may be forced to retain the drying paper towel with them for later disposal. In yet another unfortunate scenario, many patrons may simple litter by throwing their paper towel on the floor after the door has been opened.

The present invention ensures that persons passing through a door after cleansing their hands, will be able to dispense a clean paper towel, for example, dry their hands, use the paper towel to open the door, and then have a convenient receptacle for disposal for the paper towel, immediately adjacent them as they pass through the door. The present invention, therefore, allows a person to pass through a door without directly contacting the door or the door knob during exit, without increasing litter at the door, and without requiring the person to hold the door open as they attempt to dispose of the paper towel at a location remote from the door. Such a system will reduce the exposure of the public to germs and germ contaminated surfaces in public locations and may improve the general health and safety of the population. The system may also reduce litter in public locations. Moreover, the present invention may reduce slips and falls of persons placing themselves in the awkward position of attempting to throw a paper towel to a remotely located garbage can, while retaining the door in the opening condition without contacting the door with their freshly cleansed hands. Moreover, the present invention may increase cleaning time of such locations by reducing litter and allowing easy mopping of floors by decreasing the number of trash receptacles that may be positioned on the floor. With these many advantages in mind, embodiments of the present invention are described below.

Figure 1:
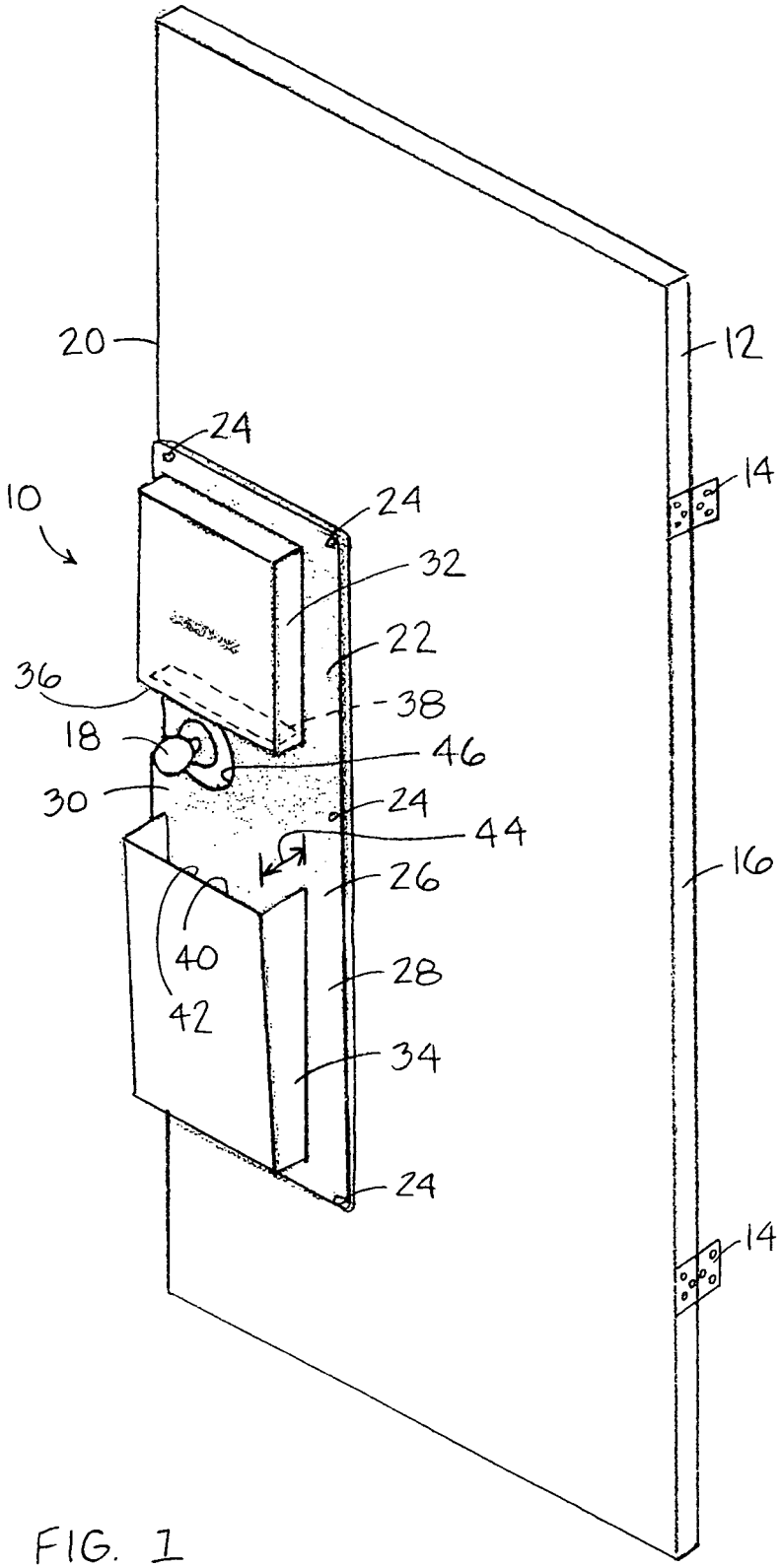
FIG. 1 is an isometric view showing one example embodiment of the sanitary dispensing system installed on a door.

FIG. 1 is an isometric view showing one example embodiment of a sanitary dispensing system 10 installed on a door 12. Door 12 may be a pre-existing door that may have been installed prior to installation of sanitary dispensing system 10. In another embodiment, door 12 may be mounted initially with system 10 mounted thereon. Door 12 may be mounted to a door frame (not shown) by hinges 14 positioned on a hinged side 16 of door 12. A door opening device, such as a door knob 18, may be positioned adjacent a swinging or opening side 20 of door 12, opposite from hinged side 16 of door 12. In another embodiment, such as a dual action hinged door that may swing in both directions, door opening device 18 may be a flat panel that is pushed by a person exiting the swinging door. In other embodiments, opening device 18 may be a latch or an electronic, depressible pad.

Dispensing system 10 may include an elongate door covering member 22 that may be secured to door 12 by a fastener, such as by a plurality of wood or metal screws 24, for example. In other embodiments, fastener 24 may be adhesive, a weld, bolts, snaps, mating hook and pile material, or any other fastening means. Member 22 may be manufactured of a durable material, such as metal, so as to withstand repeated contact with the hands of persons passing through door 12. Member 22 may also include an outer surface 26 that may be manufactured of an easy to clean surface, such as stainless steel, and which may be coated with an antimicrobial coating 28 thereon. Antimicrobial coating 28 may kill germs upon contact and may inhibit the propagation of germs on the covering member 22. Member 22 generally is manufactured in a size sufficient to cover a hand-contacting region 30 of door 12, and sufficient to provide support for a dispensing device 32 and a receptacle device 34, mounted thereon.

System 10 may further include a dispensing device 32 mounted on member 22. Dispensing device 32 may function to facilitate the drying and/or cleaning of the hands or face of a person passing through door 12. Dispensing device 32 may include a dispensing opening 36, such as on an underside thereof, which may allow the dispensing of material 38 therefrom. In one embodiment, material 38 may be dry paper utilized for drying hands after hand washing. In another embodiment, material 38 may be moistened cloths, which may include an antimicrobial jell impregnated therein or coated thereon, for example. In another embodiment, material 38 may be a roll of dry cloth. In still another embodiment, material 38 may be air and dispensing device 32 may be a dryer, such as an electric or a battery operated hand dryer.

System 10 may also include a receptacle device 34 mounted on member 22, generally on a lower region thereof. Receptacle device 34 may function to contain trash, such as material 38 dispensed from dispensing device 32. Receptacle device 34 may include a receptacle opening 40, such as on a topside thereof, which may allow the dispensing of material 38 or other used material or garbage, into receptacle 34. In one embodiment, material 38 may be received directly within receptacle 34. In another embodiment, receptacle 34 may include a liner, such as a plastic garbage bag 42, which may be secured over a lip of receptacle 34 and may be retained in place by clips (not shown) or the like.

Dispensing device 32 and receptacle device 34 may define a small profile, i.e., the devices 32 and 34 may extend outwardly from door 12 only a short distance 44, such as four inches or the like, such that the devices will not interfere with persons passing though door 12. In other embodiments, where space constraints are not an issue, distance 44 that devices 32 and 34 extend outwardly from door 12 may be larger, such as twelve inches or the like. Device 32 and 34 are secured to and extend outwardly from member 22 such that an opposite side of member 22 may be flat (see FIG. 3). Accordingly, system 10 of the present invention may not require holes to be cut into a door 12 such that the system 10 is easily mounted on a pre-existing door with little retrofitting or damage to the door 12.

Dispensing device 32 and receptacle device 34 may be manufactured of a durable material such as metal or plastic, and may include an easily cleaned outer surface 26 manufactured of stainless steel, for example. The devices 32 and 34 may be secured to member 22 by any means, such as by a weld, metal screws, wood screws, bolts, adhesive, snaps, mating hook and pile material, tabs, or the like. Member 22 may include an aperture 46 for a door opening device, such as a door knob 18, to extend therethrough. Accordingly, system 10 may be premanufactured, including member 22 and devices 32 and 34 secured thereon, so that system 10 may be easily and quickly secured on a door 12. Use of elongate member 22 in system 10 allows the system to be easily mounted on an existing door regardless of the shape or condition of the pre-existing door. For example, if a pre-existing door 12 includes many existing holes drilled therein, dents from previous abusive use, a thin or flimsy material, or other detrimental characteristics which may render it difficult to secure individual devices 32 and/or 34 thereto, member 22 may allow an installer to secure fasteners 24 anywhere within the boundaries of member 22 for a secure mounting of system 10 to door 12.

Accordingly, system 10 provides the advantage that the system may be easily, quickly and efficiently mounted on a door, even if the pre-existing door 12 does not easily facilitate the mounting of individual devices 32 and 34 thereon. System 10 also provides an easily cleanable surface 30 positioned surrounding door knob 18 and exposed between devices 32 and 34, such that the system 10 may be easily cleaned. System 10 also may provide a waterproof surface 26, such as stainless steel, between device 32 and 34, so as to prevent or reduce water damage to underlying door 12.

Furthermore, system 10 places dispensing device 32 and receptacle device 34 on door 12, at door knob 18, such that a person passing through door 12 may reduce the transmission of germs to their hands when passing through door 12. In particular, the present invention may ensure that persons passing through door 12 after cleansing their hands, will be able to dispense a clean paper towel 38, for example, dry their hands on the towel 38, use the paper towel 38 to open the exit door 12 without directly contacting the door or the door knob 18, and then have a convenient receptacle 34 for disposal for the paper towel 38, immediately adjacent them as they pass through the door 12. The present invention, therefore, allows a person to pass through door 12 without directly contacting the door 12 or the door knob 18 during passage. Such a system 10 will reduce the exposure of the public to germs and germ contaminated surfaces in public locations and therefore may improve the general health and safety of the population, and may reduce litter in public locations.

Figure 2:
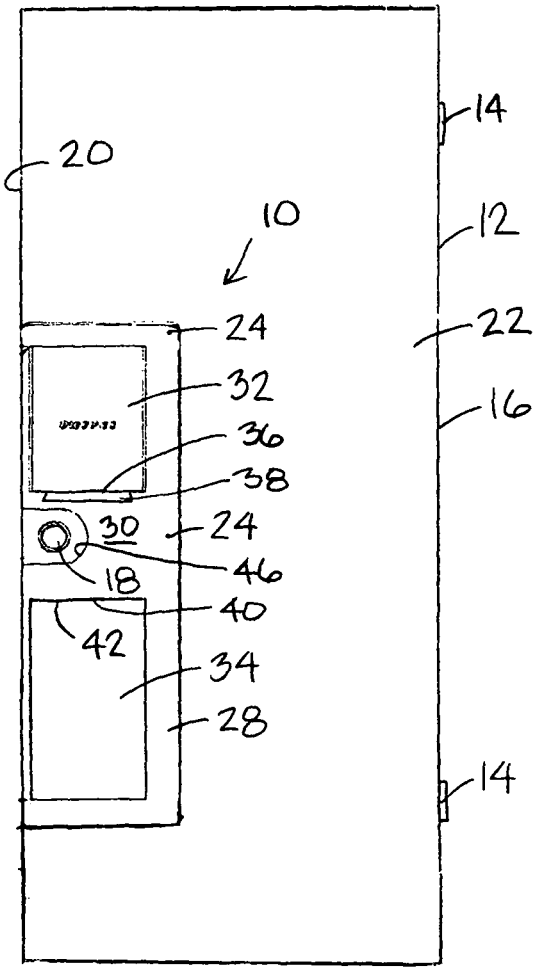
FIG. 2 is a front view of the sanitary dispensing system of FIG. 1.
Figure 3:
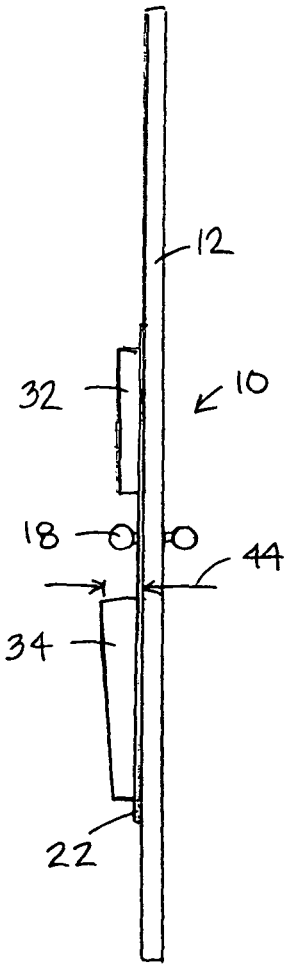
FIG. 3 is a side view of the sanitary dispensing system of FIG. 1.

FIGS. 2 and 3 are a front view of the sanitary dispensing system of FIG. 1, and a side view of the sanitary dispensing system of FIG. 1, respectively.

Figure 4:
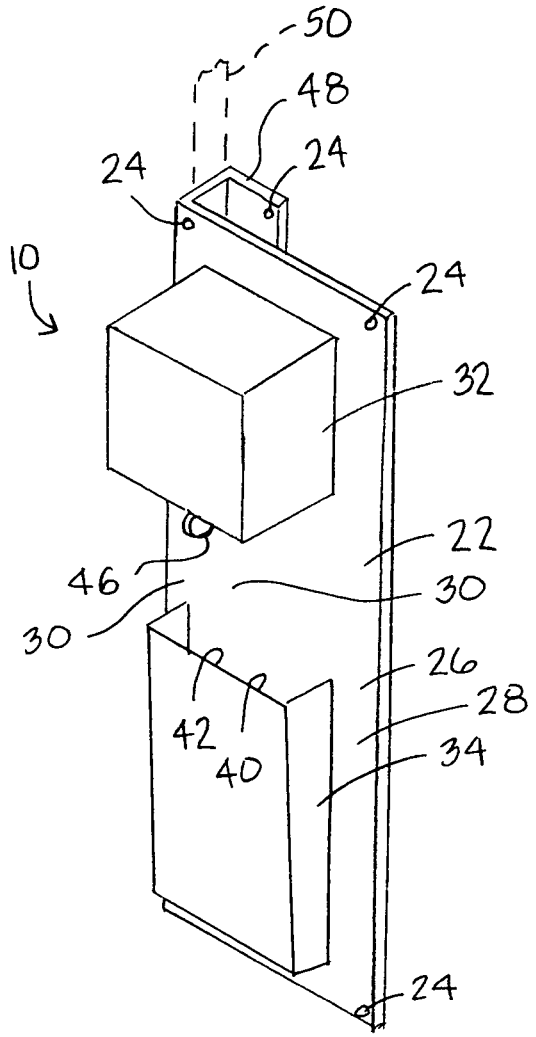
FIG. 4 is an isometric view showing another example embodiment of the sanitary dispensing system.

FIG. 4 is an isometric view showing another example embodiment of the sanitary dispensing system 10. In this embodiment member 22 includes a section 48 that may extend around an edge 50 (shown in dash lines) of a door (not shown) so that member 22 protects the edge 50 of the door and provides a germ inhibiting environment around edge 50. This embodiment may allow a patron to open the door by direct contact with the door at edge 50 while reducing the spread of germs to the patron's hands from the underlying door.

Still referring to FIG. 4, member 22 may also include an aperture 46 for a door knob wherein the door knob (not shown) may be installed after installation of member 22 on a door. In particular, aperture 46 may be manufactured of a size corresponding to an aperture drilled through a door such that when installed, the door knob will completely cover aperture 46. In this manner, member 22 will completely cover all portions 30 of the door adjacent to a door knob such that member 22 allows easy cleaning around a door knob and provides for a reduced presence of germs at the door knob. In this embodiment, dispensing device 32 may be an air dryer for paperless drying of a patron's hands or face.

Figure 5:
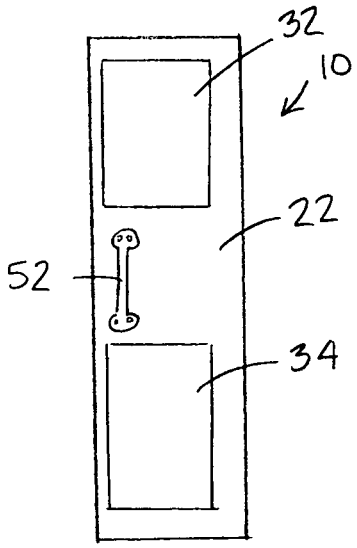
FIG. 5 is a front view of another example embodiment of the sanitary dispensing system.
Figure 7:
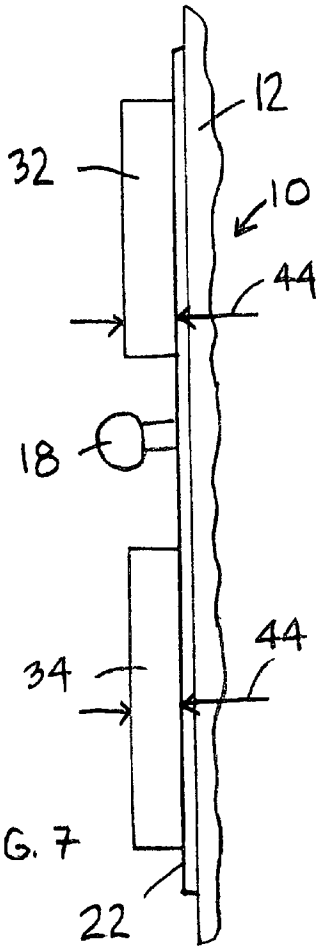
FIG. 7 is a side view of the example embodiment of FIG. 6.
Figure 6:
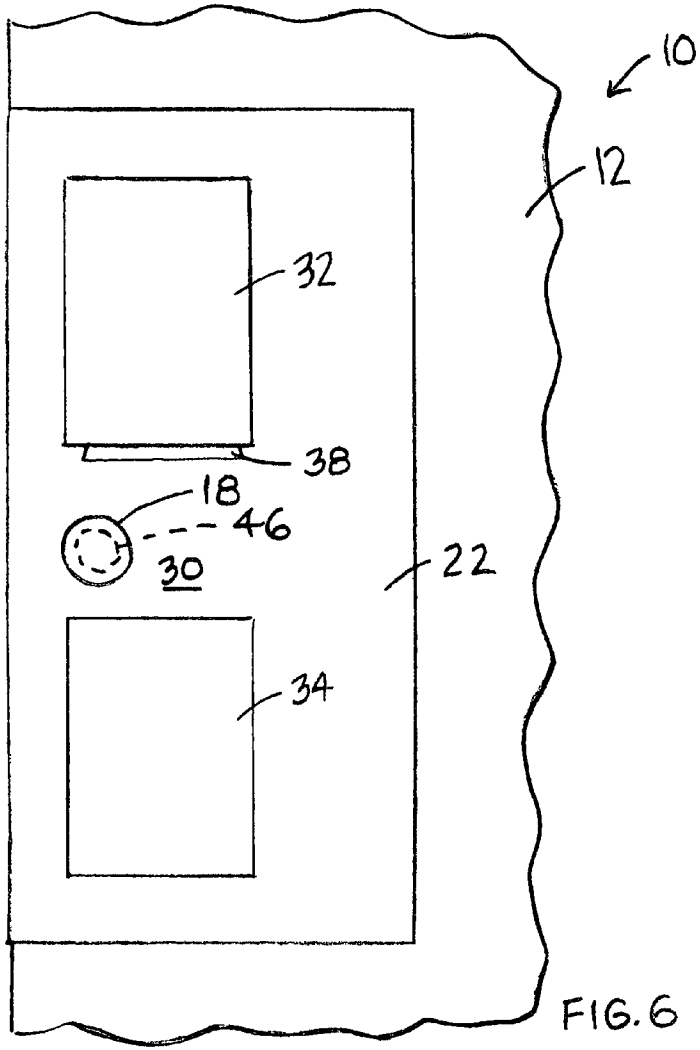
FIG. 6 is a front view of another example embodiment of the sanitary dispensing system.

As shown in FIG. 5, in other embodiments, member 22 may not include an aperture 46 and a hand contacting portion 30 of member 22 may be used as a push surface to open a door to which member 22 is secured. Member 22 may include a pull handle 52 mounted directly on member 22, thereby alleviating use of a door knob secured to the door itself. In other words, system 10 may be mounted on a flat door without a door knob or a door knob aperture, wherein system 10 provides the door handle 52 or a flat push surface 30, a dispensing device 32 and a receptacle device 34, all prefabricated on member 22. Such a system 10, therefore, facilitates a quick and easy installation procedure at the installation site.

Other variations and modifications of the concepts described herein may be utilized and fall within the scope of the claims below.

We claim:

1. A sanitary dispensing system, comprising:

a door including a first surface, a second surface positioned parallel to said first surface, and an edge surface positioned between and perpendicular to said first and second surfaces;

an elongate member secured to said door;

a dispensing device secured to said elongate member, said dispensing device configured for dispensing hand cleansing materials; and a receptacle device secured to said elongate member and configured for receiving hand cleansing materials, wherein said elongate member includes a first flat expanse secured to said first surface of said door and having said dispensing device and said receptacle device secured thereto, a second flat expanse positioned parallel to said first expanse and adjacent to said second surface of said door, and a third flat expanse positioned perpendicular to said first and second flat expanses and positioned adjacent said edge surface of said door.

2. The system of claim 1 wherein said dispensing device is chosen from one of the group consisting of a dry paper dispenser, a moistened cloth dispenser, an antimicrobial jell impregnated material dispenser, a roll of dry cloth dispenser, and an drying air dispenser.

3. The system of claim 1 wherein said elongate member includes an aperture configured to receive a door opening device therethrough and wherein an external surface of said door opening device extends over and completely covers said aperture.

4. The system of claim 1 further comprising a fastener for securing said elongate member to said door.

5. The system of claim 1 wherein said door is a pre-existing door and wherein said elongate member is mounted on said door after installation of said door.

6. The system of claim 1 further comprising a door handle extending outwardly a handle distance from said first surface of said door wherein said dispensing device and said receptacle device both extend outwardly from said elongate member a distance not greater than said handle distance.

7. The system of claim 1 wherein said elongate member includes an antimicrobial coating thereon.

8. A method of mounting a sanitary dispensing system, comprising:

providing a door including a first surface, a second surface positioned parallel to said first surface, and an edge surface extending between said first and second surfaces;

securing a dispensing device to an elongate member, said dispensing device configured for dispensing hand cleansing materials;

securing a receptacle device to said elongate member, said receptacle device configured for receiving hand cleansing materials; and securing said elongate member to said door, wherein said elongate member includes a first flat expanse secured to said first surface of said door and having said dispensing device and said receptacle device secured thereto, a second flat expanse positioned opposite said first expanse and adjacent to said second surface of said door, and a third flat expanse extending between said first and second flat expanses and positioned adjacent said edge surface of said door.

9. The method of claim 8 wherein said dispensing device and said receptacle device both extend outwardly from said elongate member a distance of not greater than four inches.

10. The method of claim 8 further comprising wherein said dispensing device is chosen from one of the group consisting of a dry paper dispenser, a moistened cloth dispenser, an antimicrobial jell impregnated material dispenser, a roll of dry cloth dispenser, and an drying air dispenser.

11. The method of claim 8 wherein said elongate member includes an aperture configured to receive internal components of a door opening device therethrough such that an external surface of said door opening device extends over a portion of said elongate member adjacent said aperture.

12. The method of claim 8 wherein said securing said elongate member comprises utilizing a fastener for securing said elongate member to said door.

13. A sanitary dispensing system, comprising:

an elongate member configured to be secured to a mounting surface of a door;

a dispensing device secured to said elongate member, said dispensing device configured for dispensing hand cleansing materials;

a receptacle device secured to said elongate member and configured for receiving hand cleansing materials; and a door handle positioned on said elongate member, said elongate member completely covering said mounting surface in a region directly adjacent to said door handle.

14. The system of claim 13 wherein said dispensing device is chosen from one of the group consisting of a dry paper dispenser, a moistened cloth dispenser, an antimicrobial jell impregnated material dispenser, a roll of dry cloth dispenser, and an drying air dispenser.

15. The system of claim 13 wherein said elongate member includes an aperture configured to receive said door handle therethrough, and wherein an external surface of said door handle extends outwardly of an edge of said aperture such that said elongate member completely covers said mounting surface in said region directly adjacent to said door handle.

16. The system of claim 13 wherein said elongate member includes a first flat expanse for securement of said dispensing device and said receptacle device thereto, and a second flat expanse, opposite said first expanse, for contacting said door when said elongate member is secured thereto, and wherein said dispensing device and said receptacle device both extend outwardly from said first flat expanse of said elongate member.

17. The system of claim 13 wherein said elongate member includes a first expanse, a second expanse parallel to said first expanse, and a third expanse extending between and perpendicular to said first and second expanses, wherein said first, second and third expanses together surrounds a door edge of said door.

18. The system of claim 13 wherein said door handle is secured only to said elongate member.

19. The system of claim 13 wherein said door handle extends outwardly a handle distance from said elongate member and wherein said dispensing device and said receptacle device both extend outwardly from said elongate member a distance not greater than said handle distance.

* * * * *